United States Patent [19]

Huston

[11] 4,285,139

[45] Aug. 25, 1981

[54] TRIG POLE FOR MASONRY CONSTRUCTION

[76] Inventor: Charles W. Huston, 6931 Waterloo Rd., NW., Canal Winchester, Ohio 43111

[21] Appl. No.: 79,817

[22] Filed: Sep. 28, 1979

[51] Int. Cl.[3] ..... G01C 15/10

[52] U.S. Cl. ..... 33/407

[58] Field of Search ..... 33/404–410

[56] References Cited

U.S. PATENT DOCUMENTS

| | | | |
|---|---|---|---|
| 1,234,282 | 7/1917 | Butler | 33/408 |
| 1,989,141 | 1/1935 | Leonard | 33/409 |
| 2,761,214 | 9/1956 | Ruble | 33/406 |
| 3,038,258 | 6/1962 | Pino | 33/407 |
| 3,101,184 | 8/1963 | Allen et al. | 33/404 X |
| 3,127,683 | 4/1964 | Garton et al. | 33/406 |
| 4,144,649 | 3/1979 | Huston | 33/409 |

*Primary Examiner*—Charles E. Phillips

*Attorney, Agent, or Firm*—Millard & Cox

[57] ABSTRACT

Disclosed is a system of poles for aligning courses of brick of a brick wall wherein there is a pole disposed at each corner of said wall and at least one pole disposed intermediate between said corner poles, all of said poles containing line blocks which carry a tensioned line therebetween, the line block on the intermediate pole for ensuring that the line remains tensioned between said corner line blocks and all of said line blocks being synchronously adjusted in vertical height so that said tensioned line defines the horizontal component of each course of brick.

4 Claims, 8 Drawing Figures

11
13
39
3
27
17
25
19
23
2
15
21

FIG. 2
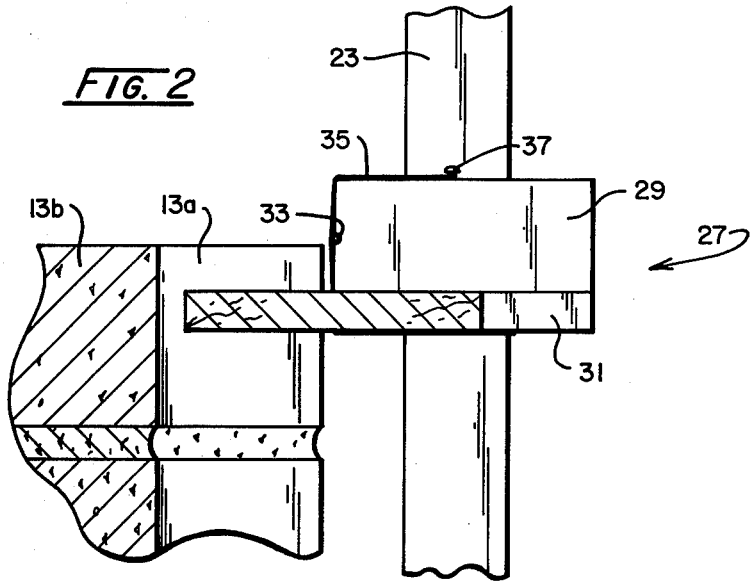
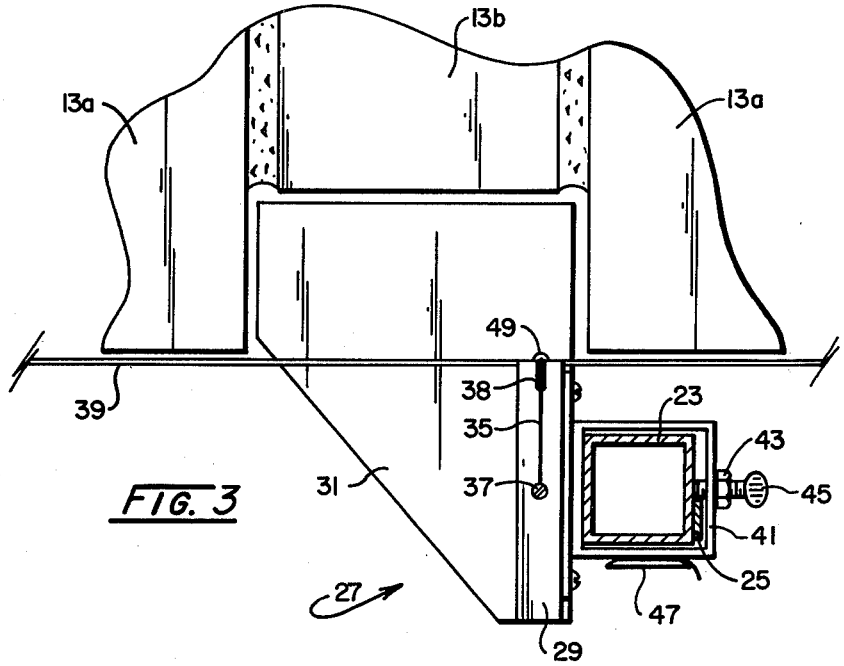
FIG. 3

TRIG POLE FOR MASONRY CONSTRUCTION

BACKGROUND OF THE INVENTION

The present invention relates to brick alignment poles used by bricklayers and more particularly to a system of such poles.

Such poles have been used for many years for assisting bricklayers in aligning courses of brick and commonly are known as "dead man" poles. An exemplary brick alignment pole can be found in U.S. Pat. No. 4,144,649, the disclosure of which is expressly incorporated herein by reference. The brick alignment pole in such patent is a versatile tool which has properly performed according to its description under most circumstances. A notable circumstance under which such alignment pole, as well as all other conventional corner alignment poles, does not entirely achieve its intended result is when the brick wall under construction is of sufficient length such that the line strung between the corner poles has a serious sway in it. Under these circumstances accurate horizontal measurement of an individual course of brick is not possible about the center of the wall between the two corner poles. Thus, there is a need in the art for some means of insuring that the line tensioned between the corner poles remains uniformly horizontal for its entire length.

BROAD STATEMENT OF THE INVENTION

The present invention solves the foregoing problem for a system of poles for aligning courses of brick of a brick wall being constructed as a facing for a building structure construction wall. In such system of poles there is a pole disposed at each corner of said wall, each corner pole including adjustable means for securing said pole at said corners, a mason's rule carried adjustably by each corner pole, and a line block adjustably carried by each corner pole wherein a line is tensioned between each line block of each corner pole. The improvement of the present invention comprises at least one pole disposed intermediate between said corner poles. The intermediate pole has adjustable means for securing the pole to the brick wall and/or the construction wall, a mason's rule adjustably carried by said intermediate pole, and an intermediate line block for insuring that the line remains tensioned between the corner line blocks. All of the line blocks are synchronously adjusted in vertical height so that the tensioned line defines the horizontal component of each course of brick being laid.

A further feature of the present invention, wherein it is desired that a vertical half-brick recess in the wall be constructed, is an intermediate line block and template assembly carried by the intermediate pole wherein such assembly not only ensures that the line remains tensioned between the corner line blocks but also provides an accurate guide for laying such vertical recessed brick portion of the wall without the need for resorting to plumb lines or the like.

BRIEF DESCRIPTION OF THE DRAWINGS

FIG. 2 is a fragmentary sectional view taken along line 2—2 of FIG. 1;

FIG. 3 is a fragmentary sectional view taken along line 3—3 of FIG. 1;

DESCRIPTION OF THE PREFERRED EMBODIMENT

Figure 1:
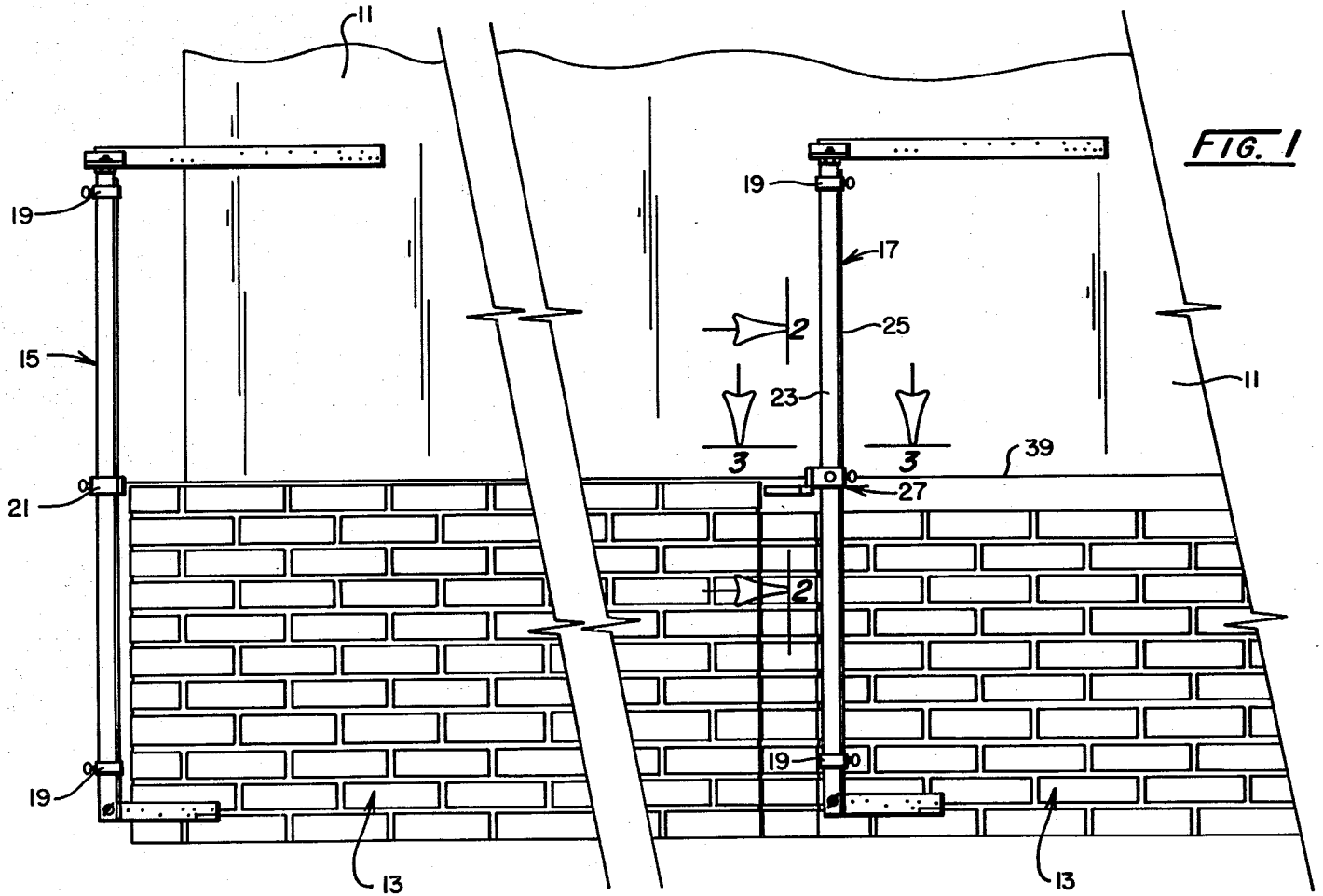
FIG. 1 is a broken elevational view of a portion of the improved pole system of the invention showing a corner pole and an intermediate pole, both being mounted in operable position on a construction wall, the actual distance between said poles being interrupted in this drawing.
Figure 4:
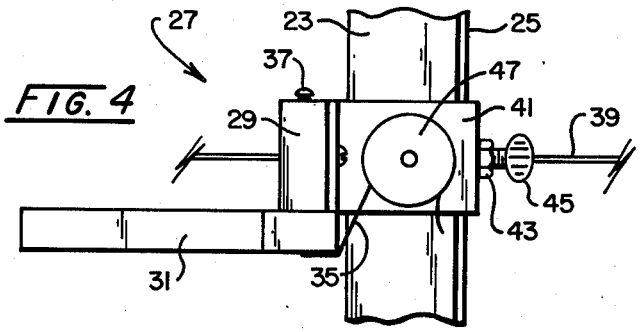
FIG. 4 is a fragmentary view of the apparatus of FIG. 2 taken from the front of the pole as shown in FIG. 1.
Figure 5:
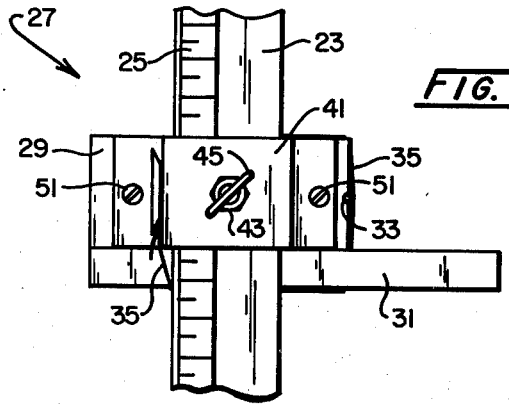
FIG. 5 is a fragmentary view of the apparatus of FIG. 2 taken from the opposite side of the view shown in FIG. 2.
Figure 6:
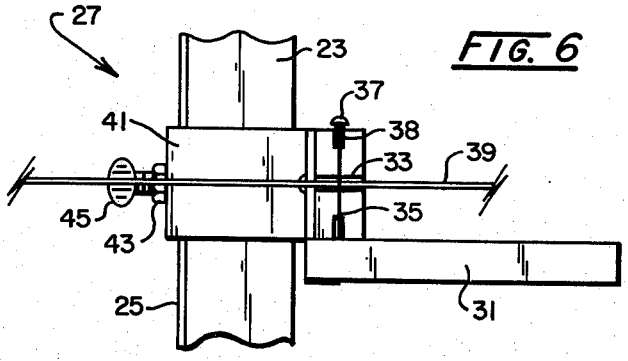
FIG. 6 is a fragmentary view of the apparatus of FIG. 2 taken from the rear side of the pole adjacent the brick wall as shown in FIG. 1.
Figure 7:
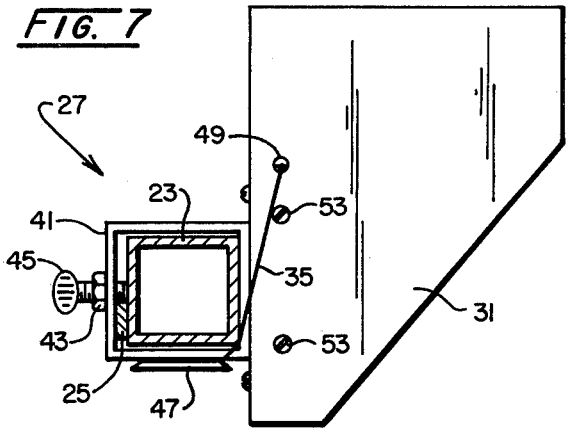
FIG. 7 is a fragmentary view of the apparatus of FIG. 3 taken from the opposite side of the view shown in FIG. 3.

The present invention is designed to be used with a construction wall wherein courses of brick are being laid to form a brick wall facing. This is shown in particular in FIG. 1 as sheathing 11 having brick 13 as a brick wall facing thereon. The conventional corner brick alignment pole 15 is shown in FIG. 1 and generally is conventional in fashion. The preferred corner brick alignment pole is that pole shown in applicant's U.S. Pat. No. 4,144,649. Other possible corner brick alignment poles which may be used in conjunction with the present invention include those poles shown in U.S. Pat. Nos. 1,872,860; 2,761,214; 2,949,673; 3,063,152; 3,104,468; and 3,349,494. As to the preferred corner brick alignment pole for use in conjunction with the present invention, it presently is preferred to replace the mason's rule securing means and the line block attaching means shown in U.S. Pat. No. 4,144,649 with scale retainer 19 and line block 21 as will be more particularly shown and described in detail later herein.

Intermediate pole 17 shown in FIG. 1 preferably is attached at its lower and upper ends in the same fashion as shown for the attachment of the preferred corner poles in U.S. Pat. No. 4,144,649. Briefly, as to such attachment means, intermediate pole 17 like corner pole 15 contains an arm pivotally attached to the lower portion of the pole which allows pivoting of the arm at times about a horizontal axis with respect to the pole and for rigidly holding the arm at times in place with respect to the pole, and means for attaching the arm to the brick wall. Near the upper end of the pole is a nail bar of substantial length which is slidably attached thereto by a transversely projecting extension of the nail bar and there are means for rigidly clamping the extension to the pole and for allowing the extension to slide to other positions. Also, there are means for securing the nail bar to the building structure construction wall. The nail bar is adjustable relative to the pole axis in the two dimensions of a plane perpendicular to the axis and the extension of the nail bar is bifrucated to slide on each side of the attaching means. The attaching means preferably comprise a threaded nut connected to a stud on the pole. Again, reference is made to U.S. Pat. No. 4,144,649 for further elaboration on the details of the means for attaching the corner poles and the intermediate pole to the brick wall and/or construction wall.

Pole 23 preferably is rectangular and hollow in shape, and is metallic in construction. Mason's rule 25 is attached to intermediate pole 23 by scale retainers 19 and assembly 27. Mason's rule 25 is conventional in having a plurality of measurements engraved thereon including measurements indicating the depth of one brick and interposed between such measurements of one brick it has measurements of spacing between the bricks and the mortar layer for the bricks. Scale retainer 19 is a square collet preferably constructed of metal and having a thumbscrew therethrough for securing rule 25 to pole 23. As was mentioned above, it is preferred that such scale retainers be used for the corner poles also. Assembly 27 is shown in detail in FIGS. 2–7 and will be described in detail in connection with such drawings.

Figure 8:
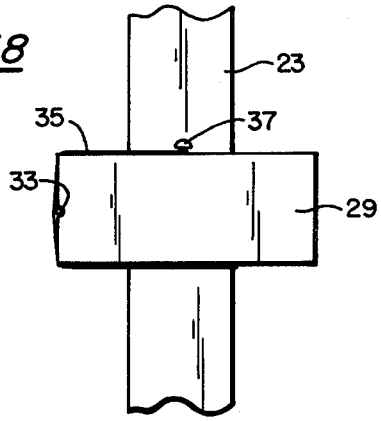
FIG. 8 is a fragmentary sectional view of an alternative intermediate line guide.

Intermediate line block and template assembly 27 as shown in FIG. 2 is composed of intermediate line block 29 and template 31. Intermediate line block 29 has line guide channel 33 (see also FIG. 6) at its end closest to the brick wall for retaining the line 39 which runs between the two corner poles. Line 39 (see FIGS. 3 and 6) is secured in line guide channel 33 by line retainer 35 which preferably is the same type of material used for the line. Line retainer 35 is connected about one of its ends at screw 37 then through slot 38 (FIG. 3) through hole 49 in template 31 and thence to convex washer 47 (FIG. 7) which is attached to square collet 41, which collet with thumbscrew 45 adjustably retains assembly 27 to pole 23. Template 31 (see also FIG. 3) is designed to enable the brick layer to lay a vertical line of brick 13*b* recessed one-half brick width (or any other desired width) from brick 13*a* which forms the brick wall being constructed. Such template eliminates three plumb points and makes for easy and efficient laying of the recessed brick. When no recess is necessary, line block 29 may be used sans template 31 as shown in FIG. 8. Note that corner line block 21 (FIG. 1) can be the same as intermediate line block 29 of FIG. 8.

As shown in FIG. 3, assembly 27 is attached to pole 23 by means of square collet 41 which has a permanent nut 43 attached thereto for receiving thumbscrew 45 therein. The thumb screw may be tightened into pressure contact with pole 23 for securing the assembly in place. Square collet 41 additionally retains rule 25 at this point. The intermediate pole is designed in size so that line 39 is intended to be one-eighth of an inch from the outer face of brick 13. The space between the brick and pole 23 is designed to be one inch. Additionally, template 31 is designed so that the one-eighth inch spacing from such template to brick 13*a* and 13*b* is maintained at the desired one-eighth inch spacing. Intermediate line block 29 is attached to template 31 by means of screws 53 shown in FIG. 7. Square collet 41 is attached to intermediate line block 29 by means of screws 51 shown in FIG. 5. The vertical height of line guide channel 33 in intermediate line block 39 is synchronously adjusted with end blocks 21 by means of thumbscrew 45 in square collet 41 so that line 39 is maintained in a tensioned condition defining the horizontal component of each course of brick being laid. This is especially helpful when the brick wall being constructed is of very great length.

Intermediate line block 29 and template 41 preferably are constructed of wood, though other durable materials of construction such as high-impact plastic or metal is acceptable. All other components of the intermediate pole preferably are of suitable metal construction as is common practice for such items in the construction industry for maintaining their durability and reliability of service.

I claim:

1. In a system of poles for aligning courses of brick of a brick wall being constructed as a facing for a building structure construction wall, wherein there is a pole disposed at each corner of said wall, each corner pole including adjustable means for securing said pole at said corners, a mason's rule carried adjustably by each corner pole, and a corner line block adjustably carried by each corner pole wherein a line is tensioned between each corner line block of each corner pole, the improvement which comprises:

at least one pole disposed intermediate between said corner poles, said intermediate pole having adjustable means for securing said pole to said brick wall and/or said construction wall, a mason's rule adjustably carried by said intermediate pole, and an intermediate line block for ensuring that said line remains tensioned between said corner line blocks, all of said line blocks being synchronously adjusted in vertical height so that said tensioned line defines the horizontal component of each course of brick, said intermediate line block has attached thereto a template having a rectangular portion which extends inside the outer vertical plane of said brick wall when said intermediate pole is in an operable position, said rectangular portion defining the position for a brick recessed from said vertical plane of said brick wall.

2. The system of poles of claim 1 wherein said mason's rule is adjustably carried by said intermediate pole by means of a collet which slidably fits around said pole and between which collet and said pole there is space for said mason's rule to be interposed therebetween, said collet having a nut permanently attached thereto and a thumbscrew which fits into said nut and by which said collet can be stationarily secured to said pole which stationarily securing said rule.

3. The system of claim 1 wherein said rule has a plurality of measurements engraved thereon including measurements indicating the depth of one brick and interposed between such measurements of one brick in each and measurement of the spacing between the bricks and the mortar layer for the bricks.

4. The system of poles of claim 1 wherein said intermediate line block has a slot for receiving said tensioned line and means for securing said line in said slot.

* * * * *